US008359194B2

(12) United States Patent
Briand et al.

(10) Patent No.: US 8,359,194 B2
(45) Date of Patent: Jan. 22, 2013

(54) DEVICE AND METHOD FOR GRADUATED ENCODING OF A MULTICHANNEL AUDIO SIGNAL BASED ON A PRINCIPAL COMPONENT ANALYSIS

(75) Inventors: Manuel Briand, Djursholm (SE); David Virette, Pleumeur-Bodou (FR)

(73) Assignee: France Telecom, Paris (FR)

( * ) Notice: Subject to any disclaimer, the term of this patent is extended or adjusted under 35 U.S.C. 154(b) by 1130 days.

(21) Appl. No.: 12/293,072

(22) PCT Filed: Mar. 8, 2007

(86) PCT No.: PCT/FR2007/050897

§ 371 (c)(1),
(2), (4) Date: Sep. 15, 2008

(87) PCT Pub. No.: WO2007/104883

PCT Pub. Date: Sep. 20, 2007

(65) Prior Publication Data

US 2009/0083045 A1 Mar. 26, 2009

(30) Foreign Application Priority Data

Mar. 15, 2006 (FR) ..... 06 50883

(51) Int. Cl.
*G10L 19/02* (2006.01)

(52) U.S. Cl. ..... 704/205; 381/23; 381/22

(58) Field of Classification Search ..... 381/23, 381/22; 704/E19.005, 500, 205
See application file for complete search history.

(56) References Cited

U.S. PATENT DOCUMENTS

| | | | | |
|---|---|---|---|---|
| 6,016,473 | A * | 1/2000 | Dolby | 704/500 |
| 6,292,830 | B1 * | 9/2001 | Taylor et al. | 709/224 |
| 7,725,324 | B2 * | 5/2010 | Bruhn et al. | 704/500 |
| 7,751,572 | B2 * | 7/2010 | Villemoes et al. | 381/23 |
| 2003/0198357 | A1 * | 10/2003 | Schneider et al. | 381/94.2 |
| 2004/0076301 | A1 * | 4/2004 | Algazi et al. | 381/17 |
| 2009/0316914 | A1 * | 12/2009 | Henn et al. | 381/23 |

FOREIGN PATENT DOCUMENTS

| | | |
|---|---|---|
| WO | WO 03/085645 | 10/2003 |
| WO | WO 2004/086817 | 10/2004 |

OTHER PUBLICATIONS

R.G. Van Der Waal, et al., "Subband coding of stereophonic digital audio signals", Speech Processing 2, VLSI, Underwater Signal Processing, International Conference on Acoustics, Speech and Signal Processing, vol. 2, No. 16, pp. 3601-3604, Apr. 14, 1991.

* cited by examiner

*Primary Examiner* — Jakieda Jackson
(74) *Attorney, Agent, or Firm* — Cozen O'Connor

(57) ABSTRACT

A system and a method for the scalable coding of a multichannel audio signal comprising a principal component analysis (PCA) transformation of at least two channels (L, R) of the audio signal into a principal component (CP) and at least one residual sub-component (r) by rotation defined by a transformation parameter (θ), comprising the following steps: formation of a frequency subband-based residual structure ($Sf_r$) on the basis of the at least one residual sub-component (r), and definition of a coded audio signal (SC) comprising the principal component (CP), at least one residual structure ($Sf_r$) of a frequency subband and the transformation parameter (θ).

21 Claims, 12 Drawing Sheets

DEVICE AND METHOD FOR GRADUATED ENCODING OF A MULTICHANNEL AUDIO SIGNAL BASED ON A PRINCIPAL COMPONENT ANALYSIS

RELATED APPLICATIONS

This is a U.S. national stage under 35 USC 371 of application Ser. No. PCT/FR2007/050897, filed on Mar. 8, 2007.

This application claims the priority of French patent application no. 06/5088 filed Mar. 15, 2006, the content of which is hereby incorporated by reference.

TECHNICAL FIELD OF THE INVENTION

The invention pertains to the field of the coding by principal component analysis of a multi-channel audio signal for digital audio transmissions on diverse transmission networks at various bit rates. More particularly, the invention is aimed at allowing bit rate-based graduated (also known as scalable) coding so as to adapt to the constraints of the transmission network or to allow audio rendition of variable quality.

BACKGROUND OF THE INVENTION

Within the framework of the coding of multi-channel audio signals, two approaches are particularly known and used.

The first and older consists in matrixing the channels of the original multi-channel signal so as to reduce the number of signals to be transmitted. By way of example, the Dolby® Pro Logic® II multi-channel audio coding method carries out the matrixing of the six channels of a 5.1 signal into two signals to be transmitted. Several types of decoding can be carried out so as to best reconstruct the six original channels.

The second approach, called parametric audio coding, is based on extracting spatialization parameters so as to reconstitute the listener's spatial perception. This approach is based mainly on a method called "Binaural Cue Coding" (BCC) which is aimed on the one hand at extracting and then coding the indices of the auditory localization and on the other hand at coding a monophonic or stereophonic signal arising from the matrixing of the original multi-channel signal.

Furthermore, an approach exists which is a hybrid of the above two approaches based on a procedure called "Principal Component Analysis" (PCA). Specifically, PCA can be seen as a dynamic matrixing of the channels of the multi-channel signal to be coded. More precisely, PCA is obtained through a rotation of the data whose angle corresponds to the spatial position of the dominant sound sources at least for the stereophonic case. This transformation is moreover considered to be the optimal decorrelation procedure which makes it possible to compact the energy of the components of a multi-component signal. An exemplary PCA-based stereophonic audio coding is disclosed in documents WO 03/085643 and WO 03/085645.

Specifically, FIG. 11 is a schematic view illustrating an encoder 109 for PCA-based stereophonic coding according to the above prior art.

This encoder 109 carries out adaptive filtering of the components arising from the PCA of the original stereo signal comprising the channels L and R.

The encoder comprises rotation means 102, PCA means 104, prediction filtering means 106, subtraction means 108, multiplication means 110, addition means 112, first and second audio coding means 129*a* and 129*b*.

The rotation means 102 carry out a rotation of the channels L and R according to an angle $\alpha$ thus defining a principal component y and a residual component r. The angle $\alpha$ is determined by the PCA means 104 so that the principal component y exhibits a higher energy than that of the residual component r.

The multiplication means 110 multiply the residual component r by a scalar $\gamma$. The result of the multiplication $r\gamma$ is added by the addition means 112 to the principal component y. The result of the addition $r\gamma+y$ is introduced into the prediction filtering means 106.

The filtering parameter $F_p$ which defines the prediction filtering means 106 is coded by the second coding means 129*b* to generate a coded filtering parameter $F_{pe}$.

Moreover, the result of the addition $r\gamma+y$ is also coded by the first coding means 129*a* to generate a coded principal component $y_e$.

Thus, the procedure consists in determining the parameters of the prediction filtering means such that these filtering means can generate an estimation of the residual component r arising from the PCA on the basis of the principal component y which has the greatest energy.

FIG. 12 is a schematic view illustrating a decoder 115 for decoding a stereophonic signal coded by the encoder of FIG. 11.

The decoder 115 comprises first and second decoding means 141*a* and 141*b*, filtering means 120, inverse rotation means 118 and addition and multiplication means 122*a* and 122*b*.

The decoder 115 then carries out the inverse operation by decoding the principal component $y'_e$ by the first decoding means 141*a* forming a decoded principal component y', then by carrying out its filtering by the filtering means 120 into a filtered residual component r' on the basis of the filtering parameters $F_p$.

The multiplication means 122*b* multiply the filtered residual component r' with the scalar $\gamma$ forming the product $r'\gamma$. The addition means 122*a* make it possible to subtract $r'\gamma$ from the decoded principal component y'.

The inverse rotation means 118 apply the inverse rotation matrix as a function of the angle of rotation a to the signals y' and r' so as to generate the channels L' and R' of the decoded stereophonic signal.

However, the PCA carried out according to the prior art does not adapt to the constraints of the transmission network and does not make it possible to obtain a fine characterization of the signals to be coded.

SUMMARY OF THE INVENTION

One aspect of the present invention relates to a scalable coding method of a multi-channel audio signal comprising a principal component analysis transformation of at least two channels of the said audio signal into a principal component and at least one residual sub-component by rotation defined by a transformation parameter. The method comprises the following steps:

- formation of a frequency subband-based residual structure on the basis of the said at least one residual sub-component, and
- definition of a coded audio signal comprising the said principal component, at least one residual structure of a frequency subband and the said transformation parameter.

Thus, the audio coding is graduated in bit rate. This offers the possibility of approaching an asymptotically perfect reconstruction of the original signals. Specifically, using a higher bit rate, the reconstructed signal can be perceptually closer to the original signal.

Advantageously, the method comprises a formation of at least one energy parameter as a function of the said at least one residual sub-component.

The said at least one energy parameter can be formed by a frequency subband-based extraction of energy difference between a decomposition of the said principal component and the said at least one residual sub-component.

As a variant, the said at least one energy parameter corresponds to a subband-based energy of the said at least one residual sub-component.

The method comprises a frequency analysis applied to the said at least one residual sub-component as a function of the said at least one energy parameter so as to form the residual structures of the frequency subbands.

Advantageously, the method comprises a determined order of transmission of the residual structures. The said determined order of transmission can be carried out according to a perceptual order of the subbands or an energy criterion.

Advantageously, the said at least one residual sub-component is a frequency residual sub-component (A(b)) carried out according to a principal component analysis in the frequency domain.

Thus, the principal component analysis in the frequency domain by frequency subbands makes it possible to obtain a finer characterization of the signals to be coded.

The principal component analysis transformation in the frequency domain comprises the following steps:

- decomposing the said at least two channels of the said audio signal into a plurality of frequency subbands,
- calculating the said at least one transformation parameter as a function of at least a part of the said plurality of frequency subbands,
- transforming at least a part of the said plurality of frequency subbands into the said at least one frequency residual sub-component and at least one frequency principal sub-component as a function of the said at least one transformation parameter, and
- forming the said principal component on the basis of the said at least one frequency principal sub-component.

Thus, the energy of the signals arising from the PCA principal component analysis carried out by frequency subbands is more compacted in the principal component compared with the energy of the signals arising from a PCA carried out in the time domain.

Advantageously, the said plurality of frequency subbands is defined in accordance with a perceptual scale. Thus, the coding method takes account of the frequency resolution of the human auditory system.

According to another embodiment, the method comprises a frequency subband-based analysis of the said at least one residual sub-component.

According to this other embodiment, the said frequency subband-based analysis comprises the following steps:

- application of a short-term Fourier transform to the said at least one residual sub-component to form at least one frequency residual sub-component, and
- filtering of the said at least one frequency residual sub-component by a frequency windowing module to obtain the residual structures of the frequency subbands.

Advantageously, the method comprises an analysis of correlation between the said at least two channels to determine a corresponding correlation value, and in that the said coded audio signal furthermore comprises the said correlation value. Thus, the correlation value can indicate any presence of reverberation in the original signal making it possible to improve the quality of the decoding of the coded signal.

Another aspect of the present invention is directed to a method of decoding a reception signal comprising a coded audio signal constructed according to any one of the above characteristics, the said decoding method comprising a transformation by inverse principal component analysis to form at least two decoded channels corresponding to the said at least two channels arising from the said original multi-channel audio signal. The method comprises the decoding of at least one residual structure of a frequency subband so as to synthesize at least one decoded residual sub-component.

According to a first embodiment the decoding method comprises the following steps:

- receiving the coded audio signal,
- extracting a decoded principal component and at least one decoded transformation parameter,
- decomposing the said decoded principal component into at least one decoded frequency principal sub-component,
- transforming the said at least one decoded principal sub-component and the said at least one decoded residual sub-component into decoded frequency subbands, and
- combining the said decoded frequency subbands to form the said at least two decoded channels.

According to a second embodiment the decoding method comprises the following steps:

- receiving the coded audio signal,
- extracting a decoded principal component and at least one decoded transformation parameter,
- forming the said at least two channels decoded by the inverse principal component analysis as a function of the said at least one decoded transformation parameter, of the said decoded principal component and of the said at least one decoded residual sub-component.

Another aspect of the invention is directed to a scalable encoder of a multi-channel audio signal, comprising:

- transformation means based on principal component analysis transforming at least two channels of the said audio signal into a principal component and at least one residual sub-component by rotation defined by a transformation parameter,
- structure formation means for forming a frequency subband-based residual structure on the basis of the said at least one residual sub-component, and
- defining means for defining a coded audio signal comprising the said principal component, at least one residual structure of a frequency subband and the said transformation parameter.

Another aspect of the invention is directed to a scalable decoder of a reception signal comprising a coded audio signal constructed according to any one of the above characteristics, the decoder comprising:

- transformation means based on inverse principal component analysis for forming at least two decoded channels corresponding to the said at least two channels arising from the said original multi-channel audio signal, and
- frequency synthesis means 45 for decoding at least one residual structure $Sf_r(b)$ of a frequency subband so as to synthesize at least one decoded residual sub-component (r'; A'(b)).

Another aspect of the invention is directed to a system comprising the encoder and the decoder according to the above characteristics.

Another aspect of the invention is directed to a computer program downloadable from a communication network and/or stored on a medium readable by computer and/or executable by a microprocessor. The computer program comprises program code instructions for executing the steps of the coding method according to at least one of the above characteristics, when it is executed on a computer or a microprocessor.

Another aspect of the invention is directed to computer program downloadable from a communication network and/or stored on a medium readable by computer and/or executable by a microprocessor. The computer program comprises program code instructions for executing the steps of the decoding method according to at least one of the above characteristics, when it is executed on a computer or a microprocessor.

BRIEF DESCRIPTION OF THE DRAWINGS

Other features and advantages of the invention will emerge on reading the description given, hereinafter, by way of non-limiting indication, with reference to the appended drawings, in which.

DETAILED DESCRIPTION OF EMBODIMENTS

Figure 1:
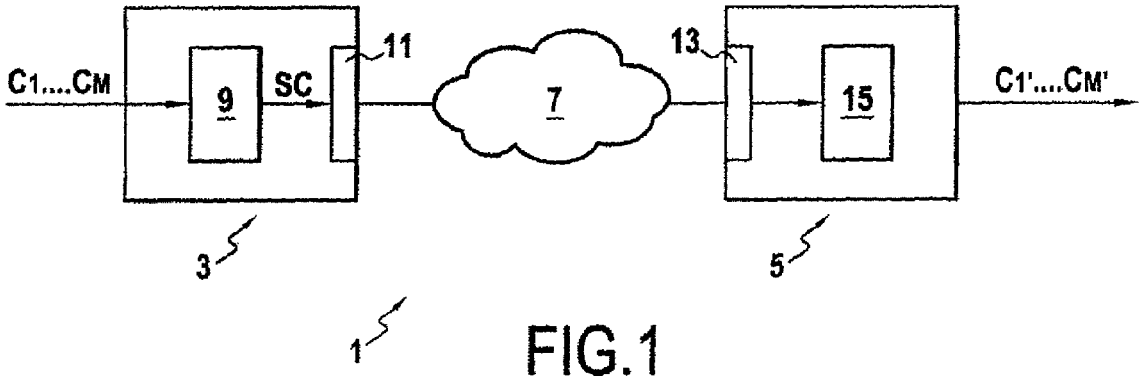
FIG. 1 is a schematic view of a communication system comprising a coding device and a decoding device according to the invention.

In accordance with the invention, FIG. 1 is a schematic view of a communication system 1 comprising a coding device 3 and a decoding device 5. The coding device 3 and decoding device 5 can be linked together by way of a communication network or line 7.

The coding device 3 comprises an encoder 9 which on receiving a multi-channel audio signal $C_1, \ldots, C_M$ generates a coded audio signal SC representative of the original multi-channel audio signal $C_1, \ldots, C_M$.

The encoder 9 can be connected to a transmission means 11 for transmitting the coded signal SC via the communication network 7 to the decoding device 5.

The decoding device 5 comprises a receiver 13 for receiving the coded signal SC transmitted by the coding device 3. Furthermore, the decoding device 5 comprises a decoder 15 which on receiving the coded signal SC generates a decoded audio signal $C'_1, \ldots, C'_M$ corresponding to the original multi-channel audio signal $C_1, \ldots, C_M$.

Figure 2:
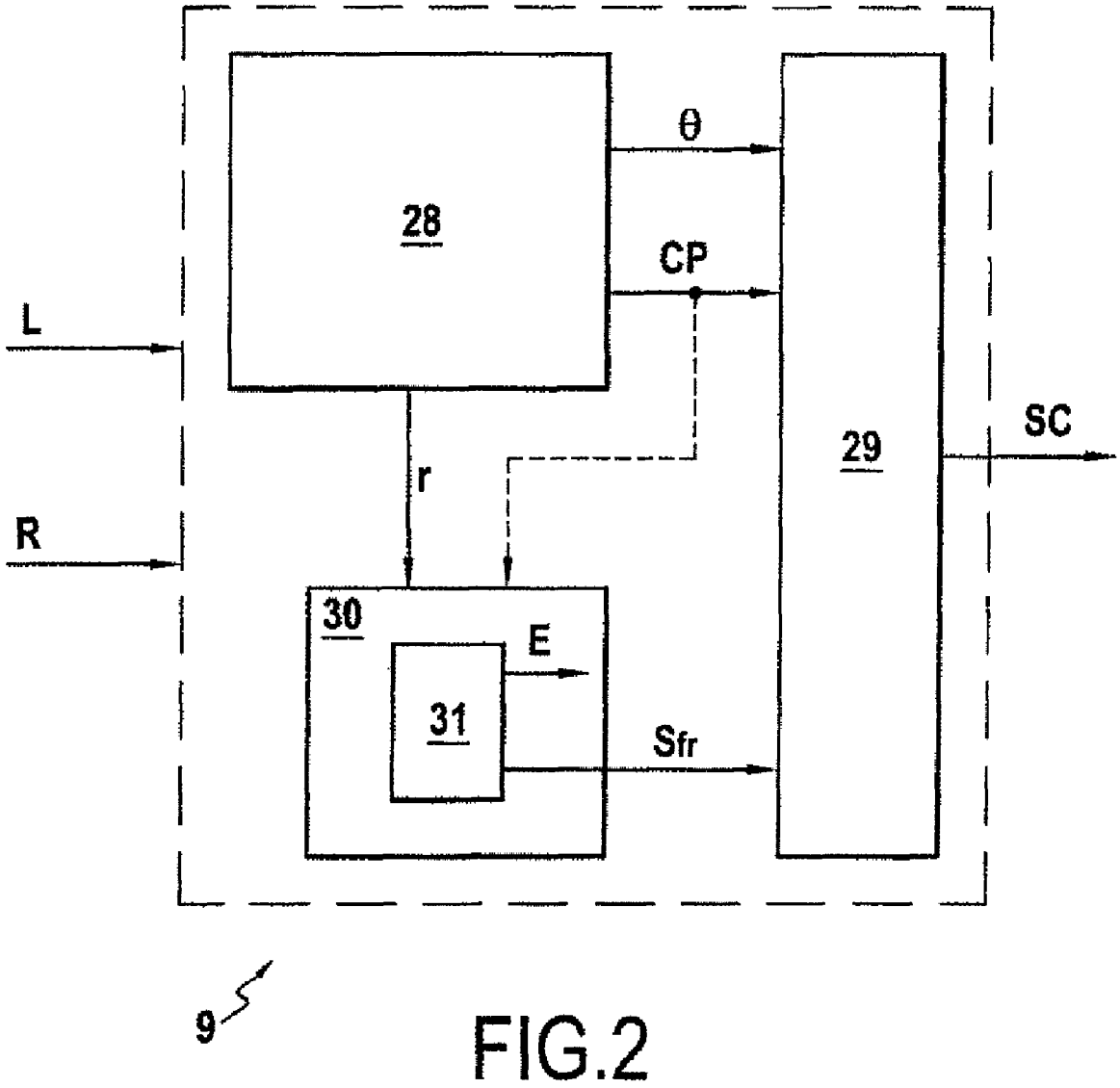
FIG. 2 is a schematic view of an encoder according to the invention.

FIG. 2 is a schematic view of a scalable encoder 9 for a scalable coding of a multi-channel audio signal according to the invention. It will be noted that FIG. 2 is also an illustration of the principal steps of the coding method according to the invention.

The encoder 9 comprises principal component analysis (PCA) transformation means 28, defining means 29 and structure formation means 30.

The principal component analysis (PCA) transformation means 28 are intended to transform at least two channels L and R of the multi-channel audio signal into a principal component CP and at least one residual sub-component r by rotation defined by a transformation parameter or angle of rotation θ.

The structure formation means 30 are intended to form a frequency subband-based residual structure $Sf_r$ on the basis of the said at least one residual sub-component r.

Furthermore, the defining means 29 are intended to define a coded audio signal SC comprising the principal component CP, at least one part of the residual structure $Sf_r$ and the said at least one transformation parameter θ.

Thus, this scalable coding allows adaptation to the constraints of the transmission network 7. It also makes it possible to reconstruct a signal perceptually closer to the original signal.

The structure formation means 30 comprise frequency analysis means 31 allowing the formation of at least one energy parameter E as a function of the said at least one residual sub-component r.

As a variant, the frequency analysis means 31 allow the formation of at least one energy parameter E by a frequency subband-based extraction of energy difference between a decomposition of the principal component CP and the residual sub-component or sub-components r. Specifically, the dotted arrow shows that the energy parameter E depends on the principal component and more particularly on a frequency decomposition of the principal component CP.

Moreover, the energy parameter or parameters E can correspond to subband-based energies of the residual sub-component or sub-components r.

Thus, the frequency analysis means 31 make it possible to apply a frequency analysis to at least one residual sub-component r as a function of at least one energy parameter E so as to form a frequency subband-based residual structure $Sf_r$.

Thus, the fine residual structure of the audio signal, over the whole of the frequency band, is composed of the residual structures of the frequency subbands thus formed. To designate the residual structure of a frequency subband, it is possible to speak of a frequency subband-based residual structure or else of a frequency band of the (global) fine residual structure.

Advantageously, this coding method adapts to the capabilities of the transmission network 7 and/or of the desired audio playback quality by virtue of the introduction of scalability in terms of coding bit rate for the residual component or ambiance.

Thus, it is possible to use a traditional monophonic audio coder (MPEG-1 Layer III or Advanced Audio Coding for example) to transmit the principal component while carrying out a flexible audio coding of the ambiance signal.

According to the coding method considered, the energy parameter E, transformation parameter θ, or filtering parameter used to generate the ambiance component r when decoding are accompanied by the fine residual structure $Sf_r$ of this ambiance signal r.

Moreover, the transmission of this residual structure $Sf_r$ can be carried out according to various determined orders of transmissions.

By way of example, the transmission of the residual structure $Sf_r$ can be carried out according to a perceptual order of the subbands or according to an energy criterion or according to a correlation of the components arising from the PCA in subbands. This ordering can also be a combination of some of these criteria.

Specifically, the order of transmission of the fine residual structure $Sf_r$ of the ambiance component (or of the ambiance components) can be put in place so as to prioritize the information to be transmitted. Certain frequency bands of the fine residual structure $Sf_r$ can be transmitted in priority. Thus, the ordering can be carried out according to frequency bands of a quantized spectral envelope. This ordering can be predefined according for example to an increasing order or according to any other order.

Furthermore, the coding method can comprise an analysis of correlation between the two channels L and R to determine a corresponding correlation value c. Thus, the coded audio signal SC can also comprise this correlation value c.

Figure 3:
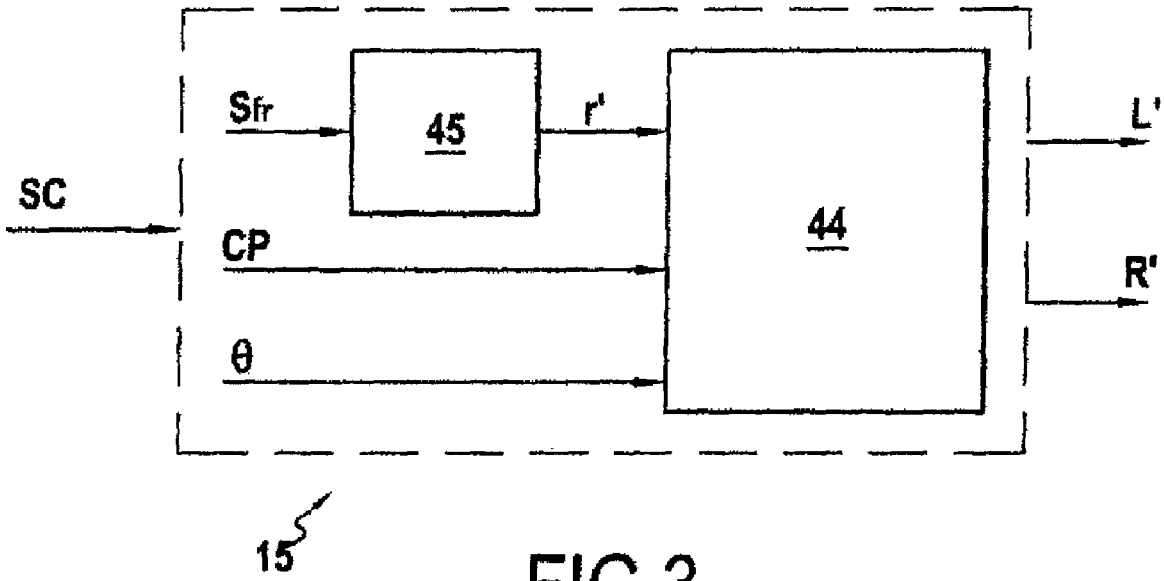
FIG. 3 is a schematic view of a decoder according to the invention.

FIG. 3 is a schematic view of a decoder 15 for decoding a reception signal comprising a coded audio signal SC constructed according to the coding method of FIG. 2.

It will be noted that FIG. 3 is also an illustration of the principal steps of the decoding method according to the invention.

The decoder 15 comprises transformation means 44 based on inverse principal component analysis ($PCA^{-1}$) and frequency synthesis means 45.

Thus, on receipt of a coded signal SC comprising a principal component CP, at least one part of a residual structure $Sf_r$ and at least one transformation parameter θ, the decoder 15 forms at least two decoded channels L' and R' corresponding to the two channels L and R arising from the original multichannel audio signal.

Specifically, the frequency synthesis means 45 allow the decoding of the frequency subband-based residual structure $Sf_r$ so as to synthesize at least one decoded residual sub-component r'.

The transformation means 44 based on inverse principal component analysis ($PCA^{-1}$) then form the two decoded channels L' and R' as a function of the decoded residual sub-component r in addition to the principal component CP and the transformation parameter θ.

Figure 4:
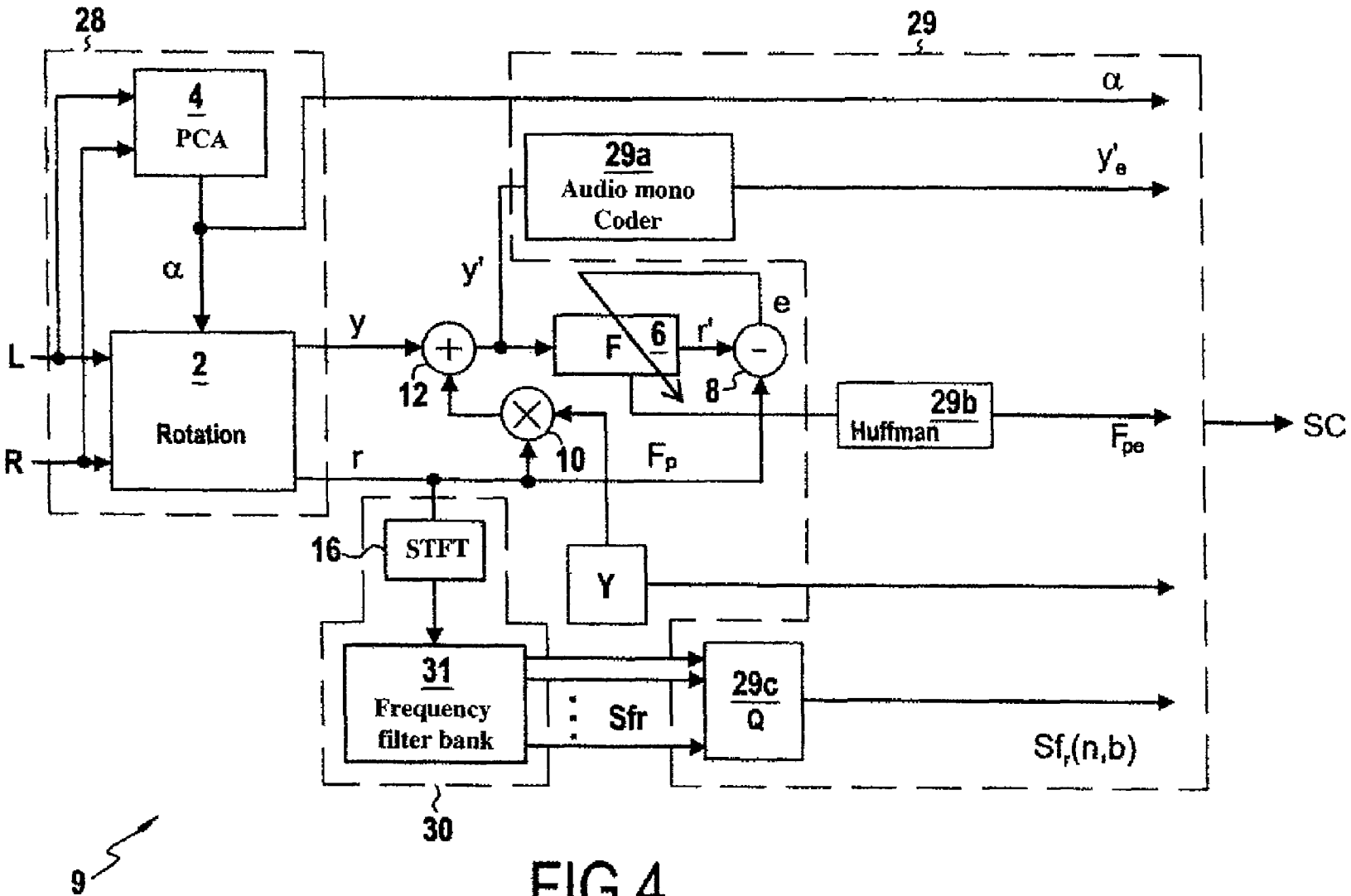
FIGS. 4 to 9 are schematic views of the encoders and decoders according to particular embodiments of the invention.

FIG. 4 is a schematic view illustrating a first embodiment of an encoder for a scalable coding of a multi-channel audio signal.

The encoder 9 comprises principal component analysis transformation means 28, defining means 29 and structure formation means 30.

The principal component analysis transformation means 28 comprise rotation means 2 and PCA means 4.

The defining means 29 comprise first and second audio coding means 29*a* and 29*b* and quantizing means 29*c*.

Furthermore, the encoder 9 comprises prediction filtering means 6, subtraction means 8, multiplication means 10 and addition means 12.

The rotation means 2 generate a principal component y and a residual sub-component r by means of a rotation of the channels L and R according to an angle α extracted from the PCA means 4.

The multiplication means 10 multiply the residual sub-component r by a scalar γ. The scalar γ allows the mixing of the signals arising from the rotation so as to facilitate the prediction of the signal r on the basis of the signal y.

The result of the multiplication rγ is added by the addition means 12 to the principal component y. The result of the addition rγ+y is applied to the first coding means 29*a* to generate a coded principal component $y'_e$.

Moreover, the result of the addition rγ+y is introduced into the prediction filtering means 6 which consist of the series association of an adaptive filter and of a reverberation filter.

The filtering parameter $F_p$ output by the prediction filtering means 6 is applied to the second coding means 29*b* to generate a coded filtering parameter $F_{pe}$.

The structure formation means 30 make it possible to add to this information the fine residual structure $Sf_r$ of the residual sub-component r or ambiance arising from the principal component analysis transformation means 28. Specifically, the use of the prediction filtering means 6 to generate a signal $F_p$ which must be decorrelated from the useful signal for prediction is not very suitable. Consequently if the decoder benefits from additional information, admittedly at a higher bit rate, then the ambiance component generated makes it possible to carry out a better conditioned inverse PCA.

The structure formation means 30 carry out a frequency subband-based analysis of the residual sub-component r.

Specifically, these structure formation means 30 comprise frequency transformation means 16 in addition to the frequency analysis means 31.

The frequency transformation means 16 make it possible (for example, by applying a short-term Fourier transform STFT to the residual sub-component r) to form at least one frequency residual sub-component r(b).

Thereafter, the frequency analysis means 31 make it possible to obtain the frequency subband-based residual structure $Sf_r$, for example by filtering the frequency residual sub-component by means of a frequency filter bank.

Thus, the fine structure $Sf_r(n,b)$ for each frequency subband b and each analysed signal portion n can be quantized by the quantizing means 29*c* and transmitted by the transmission means 11 from the coding device 3 to a decoding device 5.

Figure 5:
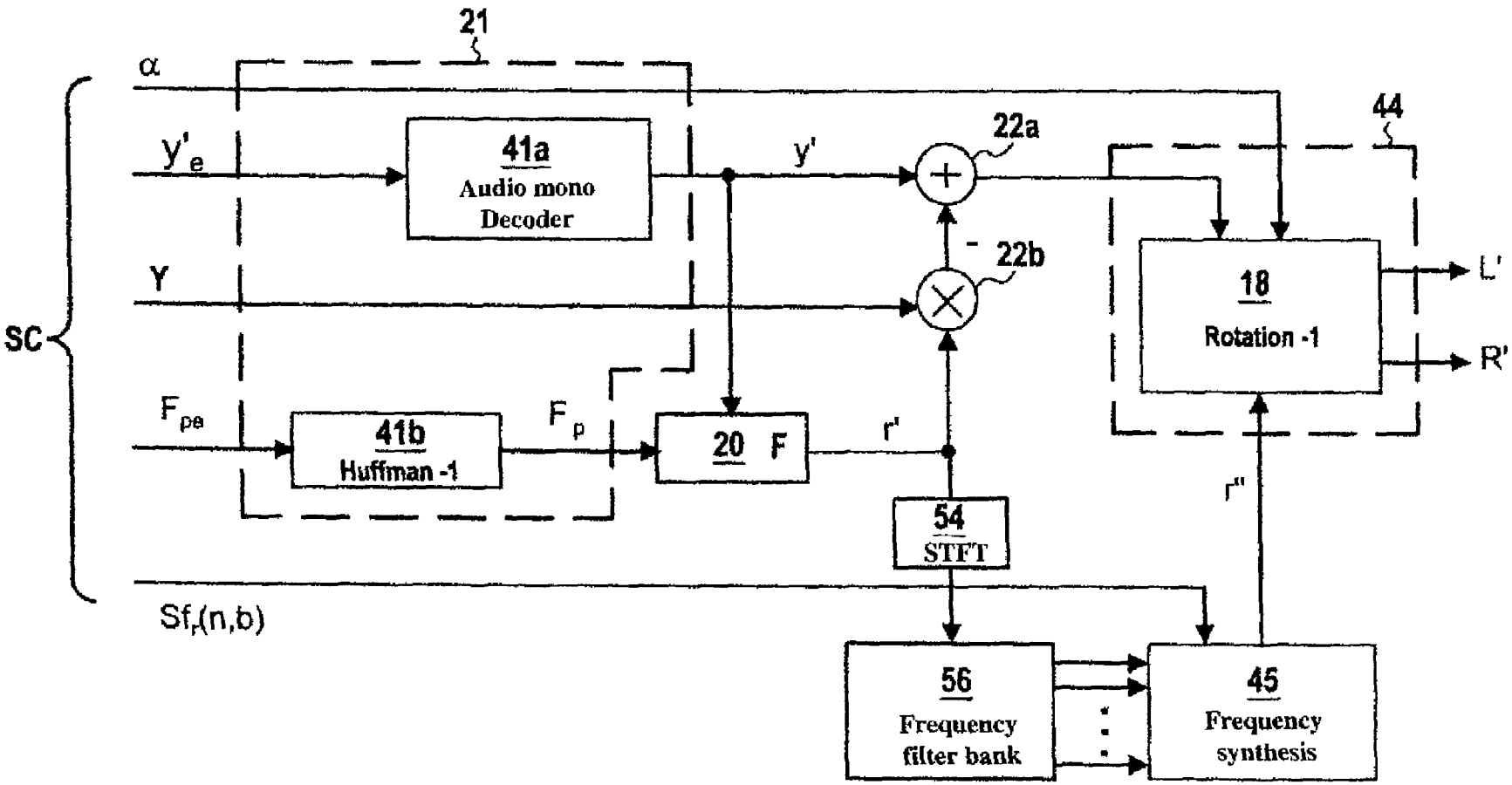

FIG. 5 is a schematic view illustrating a first embodiment of a decoder 15 for a decoding of a reception signal comprising a coded audio signal SC constructed according to the coding method of FIG. 4.

The decoder 15 comprises frequency synthesis means 45 and transformation means 44 based on inverse principal component analysis ($PCA^{-1}$) comprising inverse rotation means 18.

Furthermore, the decoder comprises extraction means 21, filtering means 20, and addition and multiplication means 22*a* and 22*b*. The extraction means 21 comprise first and second decoding means 41*a* and 41*b*.

Thus, by virtue of the reception of the coefficients of the adaptive filter $F_{pe}$, of the angle of rotation a, of the scalar γ and of the signal $y'_e$, the decoder 15 then carries out the inverse operation by decoding the principal component $y'_e$ by the first decoding means 41*a* forming a decoded principal component y', then by carrying out its filtering by the filtering means 20 into a filtered residual component r' on the basis of the filtering parameters $F_p$ arising from the second decoding means 41*b*.

The multiplication means 22*b* multiply the filtered residual component r' with the scalar γ forming the product r'γ. The addition means 22*a* make it possible to subtract r'γ from the decoded principal component y'.

The inverse rotation means 18 apply the inverse rotation matrix as a function of the angle of rotation a to the signals y' and r' so as to generate the channels L' and R' of the decoded stereophonic signal.

If the residual structure $Sf_r(n,b)$ of the frequency subbands of the component r has been transmitted by the encoder 9 then a signal r'' can be generated by the frequency synthesis means 45 before carrying out the inverse rotation by the inverse rotation means 18.

Thus, the two decoded channels L' and R' can be formed by the inverse principal component analysis as a function of the decoded transformation parameter (or angle of rotation) of the decoded principal component y' and of the decoded residual sub-component r'.

Furthermore the decoder 15 can comprise decoding frequency transformation means 54 and decoding frequency analysis means 56 making it possible to form subbands on the basis of the filtered residual component r'.

Specifically, in the case of a partial reception of the residual structure $Sf_r(n,b)$ (reception of a few frequency subbands), the frequency synthesis means 45 use the subbands arising from the synthesis r' to supplement the subbands whose fine structure has not been received.

Figure 6:
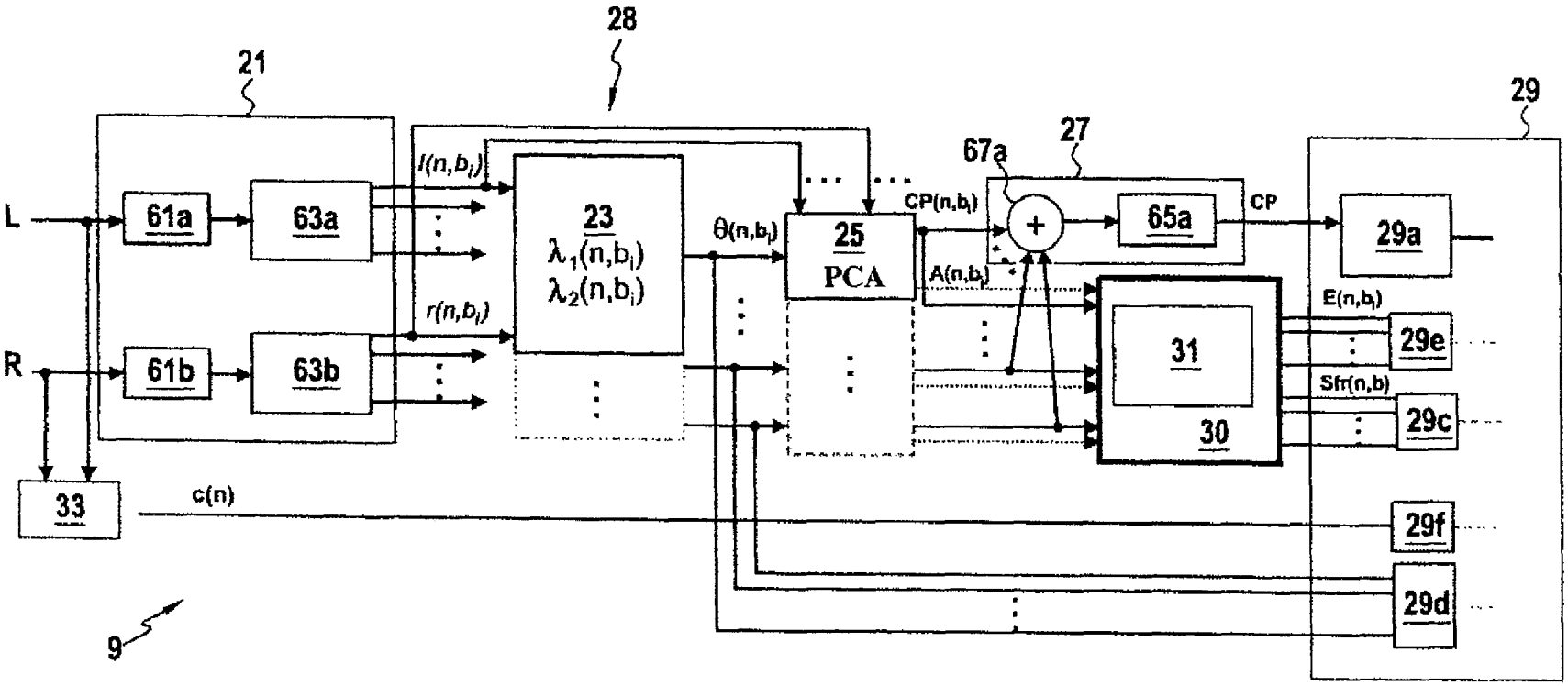

FIG. 6 is a schematic view of another embodiment of an encoder for a scalable coding of a multi-channel audio signal according to a principal component analysis (PCA) transformation in the frequency domain.

According to this example, the encoder 9 is intended to code a stereophonic signal which can be defined by a succession of frames n, n+1, etc. and comprising two channels Left L and Right R.

The encoder 9 comprises principal component analysis (PCA) transformation means 28, defining means 29 and structure formation means 30.

The principal component analysis (PCA) transformation means 28 comprise decomposition means 21, calculation means 23, PCA means 25 and combining means 27.

Thus, for a determined frame n, the decomposition means 21 decompose the two channels L and R of the stereophonic signal into a plurality of frequency subbands $l(n,b_1), \ldots, l(n,b_N), r(n,b_1), \ldots, r(n,b_N)$.

Specifically, the decomposition means 21 comprise short-term Fourier transform means (STFT) 61*a* and 61*b* and frequency windowing means 63*a* and 63*b* making it possible to group the coefficients of the short-term Fourier transform together into subbands.

Thus, a short-term Fourier transform is applied to each of the input channels L and R. These channels expressed in the frequency domain can then be windowed by frequency 63*a* and 63*b* according to N bands defined in accordance with a perceptual scale equivalent to the critical bands.

The calculation means 23 are intended to calculate at least one transformation parameter $\theta(n,b_i)$ from among a plurality of transformation parameters $\theta(n,b_1), \ldots, \theta(n,b_N)$ as a function of at least a part of the plurality of frequency subbands.

By way of example, the calculation of the transformation parameters can be carried out by calculating a covariance matrix. The covariance matrix can then be calculated by the calculation means 23 for each signal frame n analysed and for each frequency subband $b_i$.

Thus, eigenvalues $\lambda_1(n, b_i)$ and $\lambda_2(n, b_i)$ of the stereophonic signal are then estimated for each frame n and each subband $b_i$, allowing the calculation of the transformation parameter or angle of rotation $\theta(n,b_i)$.

It will be noted that it is also possible to calculate the transformation parameters solely on the basis of a covariance of the two original channels L and R.

This angle of rotation $\theta(n,b_i)$ corresponds to the position of the dominant source at frame n for subband $b_i$ and so allows the rotation or transformation means 25 to carry out a frequency subband-based rotation of the data to determine a frequency principal component $CP(n, b_i)$ and a frequency residual (or ambiance) component $A(n, b_i)$. The energies of the components $CP(n, b_i)$ and $A(n, b_i)$ are proportional to the eigenvalues $\lambda_1$ and $\lambda_2$ such that: $\lambda_1 > \lambda_2$. Consequently, the signal A(b) has a much lower energy than that of the signal CP(b).

The combining means 27 combine the frequency principal sub-components $CP(n, b_1), \ldots, CP(n, b_N)$ to form a single principal component CP(n).

Specifically, these combining means 27 comprise inverse STFT means 65*a* and addition means 67*a*. The sum by the addition means 67*a* of these limited-band frequency components $CP(n, b_i)$ then makes it possible to obtain the full-band principal component CP(n) in the frequency domain. The inverse STFT of the component CP(n) results in a full-band temporal component.

The structure formation means 30 comprising frequency analysis means 31 make it possible to form at least one energy parameter $E(n,b_i)$ from among a set of energy parameters $E(n,b_1), \ldots, E(n,b_N)$ as a function of the frequency residual sub-components $A(n,b_1), \ldots, A(n,b_N)$ and/or frequency principal sub-components $CP(n,b_1), \ldots, CP(n,b_N)$.

According to a first embodiment, the energy parameters $E(n,b_1), \ldots, E(n,b_N)$ are formed by extracting the frequency subband-based energy differences between the frequency principal sub-components $CP(n,b_1), \ldots, CP(n,b_N)$ and the frequency residual sub-components $A(n,b_1), \ldots, A(n,b_N)$.

According to another embodiment, the energy parameters $E(n,b_1), \ldots, E(n,b_N)$ correspond directly to the frequency subband-based energy of the frequency residual sub-components $A(n,b_1), \ldots, A(n,b_N)$.

Consequently, in order to better synthesize the sound ambiance, the coded audio signal SC can advantageously comprise at least one energy parameter from among the set of energy parameters $E(n,b_1), \ldots, E(n,b_N)$.

Furthermore, the structure formation means 30 make it possible to apply a frequency analysis to at least one residual sub-component $A(n,b_i)$ as a function of at least one energy parameter $E(n,b_i)$ to form the frequency subband-based residual structure $Sf_r(n,b_i)$.

Thus, if the capabilities of the transmission network 7 so allow or if a higher audio quality is expected, the energy parameter or parameters $E(n,b_1), \ldots, E(n,b_N)$ can be accompanied by at least one part of the subband-based fine structure of the residual component $A(n,b_i)$ of the signal $Sf_r(n,b_i)$.

This graduated approach to the coding of the residual component $A(n,b_i)$ offers the capability of transmitting additional information so as to approach an asymptotically perfect reconstruction of the original stereophonic signal. Specifically, using a higher bit rate, the reconstructed stereophonic signal will be perceptually closer to the original stereophonic signal.

Furthermore, the encoder 9 can comprise correlation analysis means 33 for carrying out an analysis of temporal correlation between the two channels L and R so as to determine a corresponding correlation index or value c(n). Thus, the coded audio signal SC can advantageously comprise this correlation value c(n) to indicate any presence of reverberation in the original signal.

The defining means 29 can comprise an audio coding means 29*a* for coding the principal component CP and quantizing means 29*c*, 29*d*, 29*e* and 29*f* for quantizing at least one part of the residual structure $Sf_r(n,b_i)$, the transformation parameter or parameters $\theta(n,b_i)$, at least one part of the residual structure $Sf_r(n,b_i)$, the energy parameter or parameters $E(n,b_i)$ and the correlation value c(n) respectively.

Figure 7:
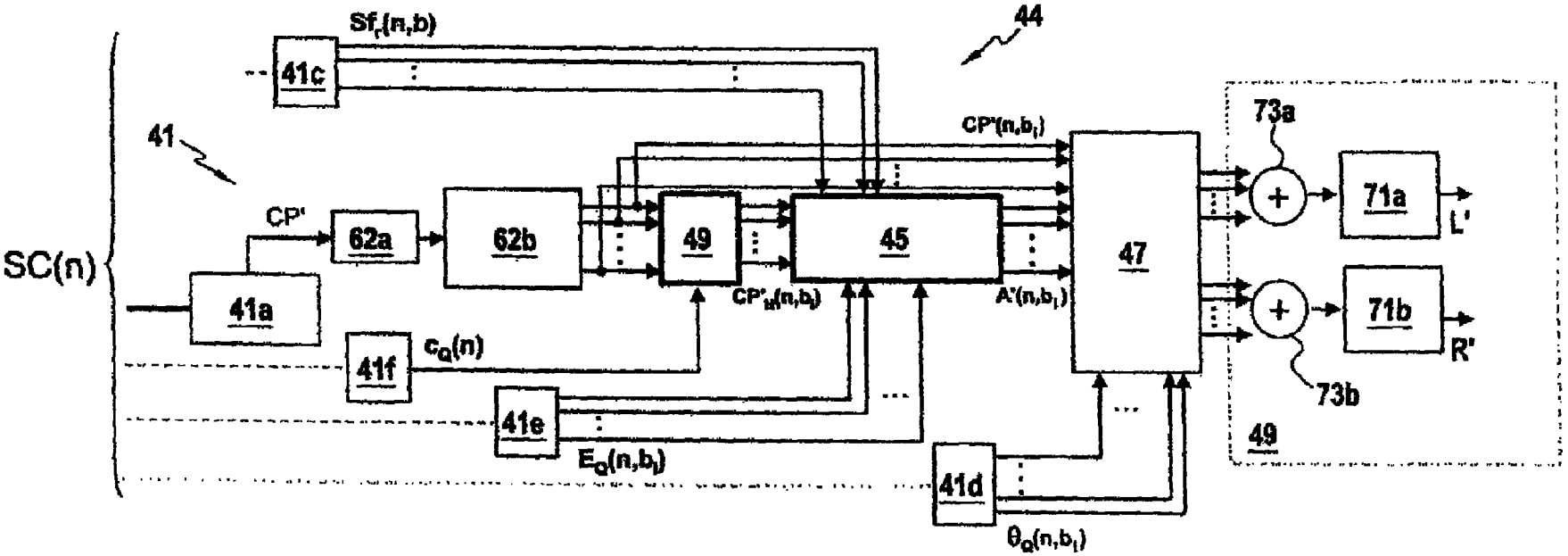

FIG. 7 is a schematic view of a decoder 15 for decoding a coded audio signal SC(n) comprising an audio stream and decoding parameters for a stereophonic signal based on a frequency subband-based inverse PCA.

The decoder 15 comprises transformation means 44 based on inverse principal component analysis ($PCA^{-1}$) and frequency synthesis means 45.

The transformation means 44 based on inverse principal component analysis ($PCA^{-1}$) comprise extraction means 41, decoding decomposition means 43, inverse transformation means 47, and decoding combining means 49.

Thus, on receipt of the coded audio signal SC(n), the extraction means 41 comprise monophonic decoding means 41*a* for extracting the decoded principal component CP' and dequantizing means 41$c$, 41$d$, 41$e$ and 41$f$ for extracting the residual structure $Sf_{rQ}(n,b_i)$, the transformation parameters or angles of rotation $\theta_Q(n,b_i)$, the energy parameters $E_Q(n,b_i)$, and the correlation value $c_Q(n)$.

The decoding decomposition means 43 comprising for example STFTs 62$a$ and filter banks 62$b$ decompose the decoded principal component CP' by a frequency windowing with N bands into decoded frequency principal sub-components.

Furthermore, a residual component $A'(n, b_i)$ can be synthesized by the frequency synthesis means 45 on the basis of the decoded audio stream $CP'(n, b_i)$, spectrally shaped by the dequantized energy parameters $E_Q(n,b_i)$ and possibly by the residual structure $Sf_{rQ}(n,b_i)$.

Specifically, the additional information transmitted by the encoder 9 may or may not be used by the decoder 15. Thus, the residual fine structure $Sf_r(n,b_i)$ of the frequency subband-based residual component $A(n,b_i)$ can therefore be used during the frequency synthesis of the signal $A'(n, b_i)$ on the basis of the decoded and possibly filtered signal CP'.

The frequency synthesis of the signal $A'(n, b_i)$ thus employs the energy parameters $E_Q(n,b_i)$ and possibly the fine structure $Sf_r(n,b_i)$ of the dequantized residual component.

The decoder 15 then carries out the operation inverse to the coder since the PCA is a linear transformation. The inverse PCA is carried out by the inverse transformation means, by multiplying the signals $CP_H'(n, b_i)$ and $A'(n, b_i)$ by the matrix transpose of the rotation matrix used for encoding. This is made possible by virtue of the inverse quantization of the angles of rotation based on frequency subbands.

It will be noted that the signals $CP'_H(n, b_i)$ correspond to the principal components $CP'(n, b_i)$ decorrelated by reverberation or decorrelation filtering means 49.

Specifically, due to the decorrelation properties of the PCA, the use of a decorrelation or reverberation filter is desirable for synthesizing a decorrelated component $CP'_H(n, b_i)$ of the signal $CP'(n, b_i)$ and as a consequence of the signal $A'(n, b_i)$.

The filtering means 49 comprise a filter whose impulse response h(n) is dependent on the characteristics of the original signal. Specifically, the temporal analysis of the correlation of the original signal at frame n determines the correlation value c(n) which corresponds to the choice of the filter to be used for decoding. By default, c(n) imposes the impulse response of an all-pass filter with random phase which greatly reduces the inter-correlation of the signals $CP'(n, b_i)$ and $CP'_H(n, b_i)$. If the temporal analysis of the stereo signal reveals the presence of reverberation, c(n) imposes the use, for example, of Gaussian white noise of decreasing energy so as to reverberate the content of the signal $CP'(n, b_i)$.

The combining means 49 comprising inverse STFT means 71$a$ and 71$b$ and addition means 73$a$ and 73$b$ combine the decoded frequency subbands to form two decoded components L' and R'.

This graduated approach to the coding of the residual component $A(n, b_i)$ offers the capability of transmitting additional information so as to approach a reconstruction that is very close to the original stereophonic signal.

Figure 8:
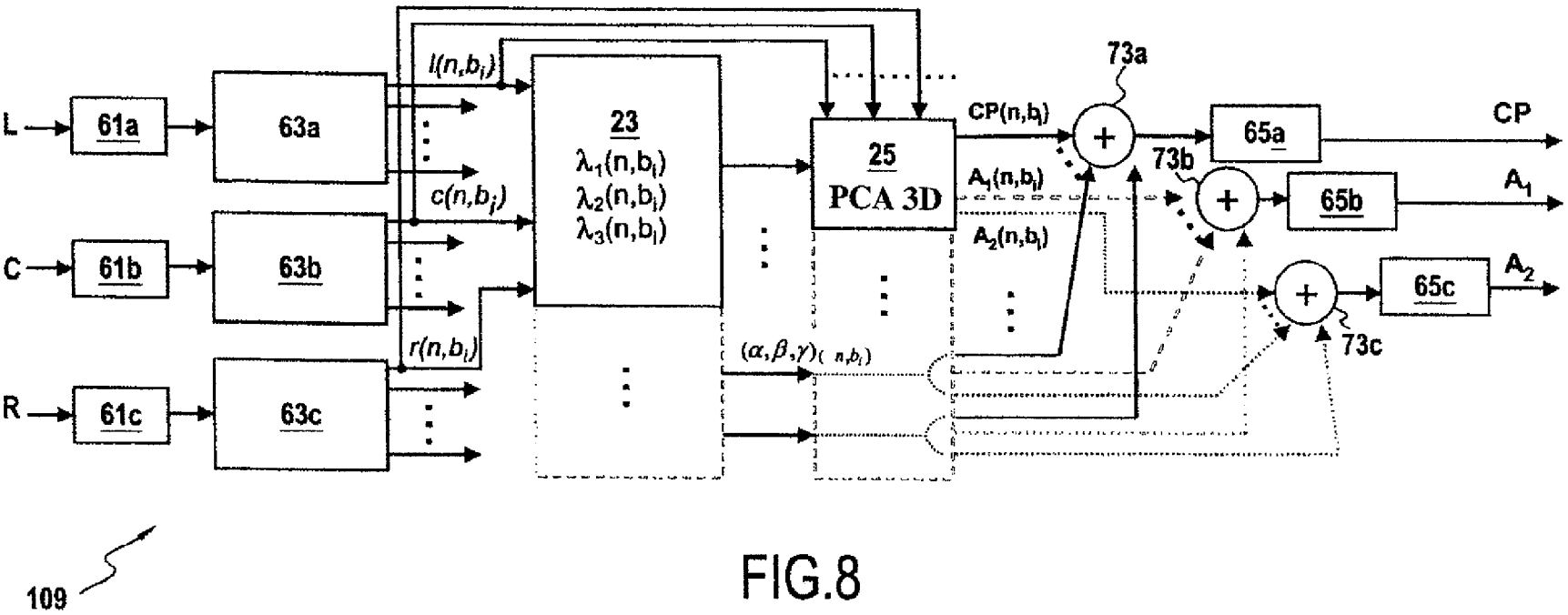

FIG. 8 illustrates an encoder 109 of a multi-channel signal applying the PCA to three channels. Specifically, this encoder uses a three-dimensional PCA of the signal with three channels parametrized by the Euler angles $(\alpha,\beta,\gamma)_b$ estimated for each subband b.

The encoder 109 is distinguished from that of FIG. 7 by the fact that it comprises three short-term Fourier transform means (STFT) 61$a$, 61$b$ and 61$c$ as well as three frequency windowing modules 63$a$, 63$b$ and 63$c$.

Furthermore, it comprises three inverse STFT means 65$a$, 65$b$ and 65$c$ as well as three addition means 73$a$, 73$b$ and 73$c$.

The PCA is then applied to a triple of signals L, C and R. The 3D three-dimensional PCA is then carried out by a 3D rotation of the data, parametrized by the Euler angles $(\alpha,\beta,\gamma)$. Just as for the stereophonic case, these angles of rotation are estimated for each frequency subband on the basis of the covariance and eigenvalues of the original multi-channel signal.

The signal CP contains the sum of the dominant sound sources and the part of the ambiance components which coincides spatially with these sources present in the original signals.

The sum of the secondary sound sources, which spectrally overlap with the dominant sources, and of the other ambiance components is distributed proportionately to the eigenvalues $\lambda_2$ and $\lambda_3$ in the signals $A_1$ and $A_2$ which have markedly less energy than the signal CP since: $\lambda_1>\lambda_2>\lambda_3$.

Thus, the coding method applied to the stereophonic signals can be extended to the case of multi-channel signals $C_1, \ldots, C_6$ of 5.1 format comprising the following channels: Left L, Centre C, Right R, Back Left (Left surround) Ls, Back Right (Right surround) Rs, and Low Frequency (Low Frequency Effect) LFE.

Figure 9:
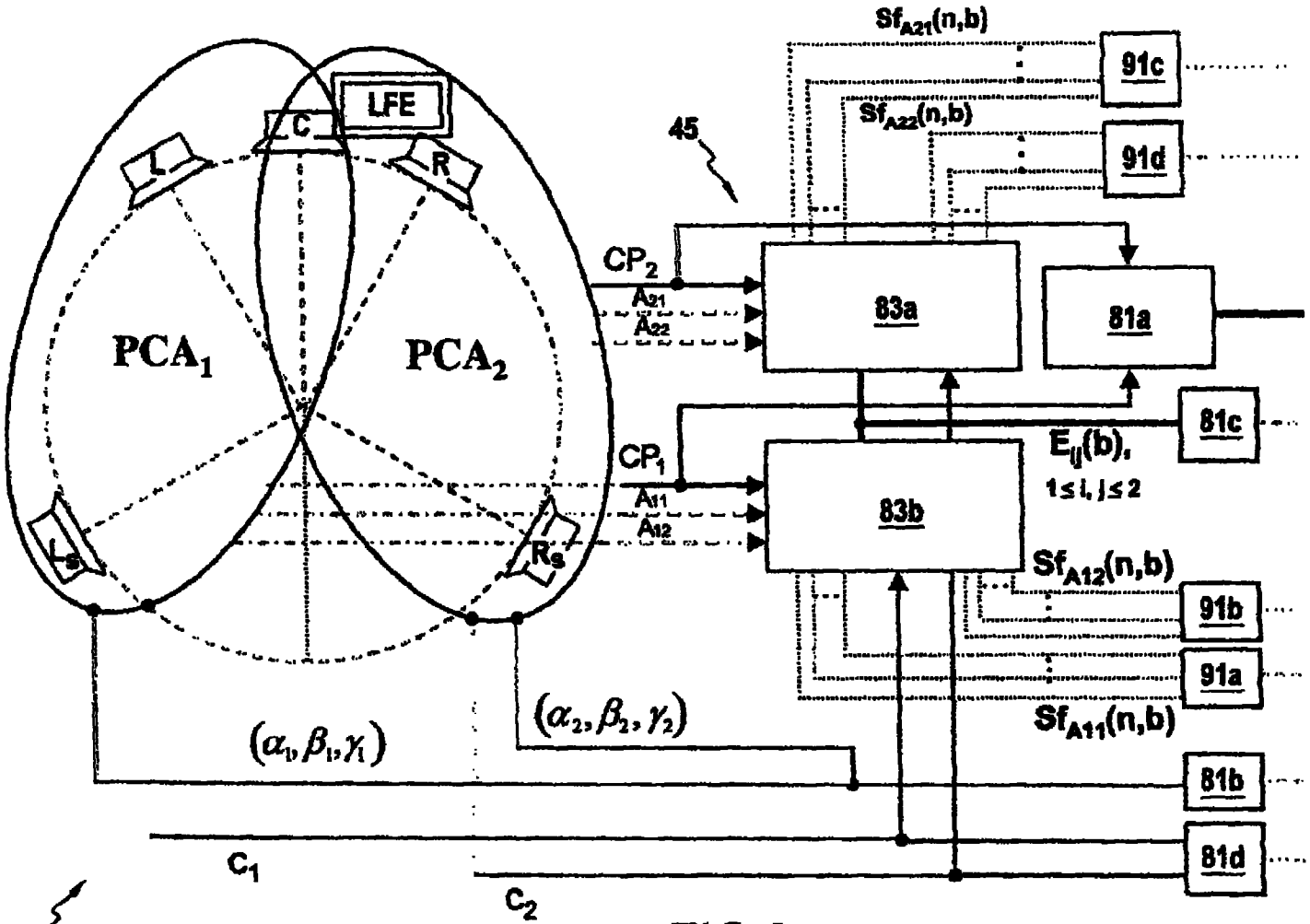

Specifically, FIG. 9 is a schematic view illustrating an encoder 209 of a 5.1 format multi-channel signal. According to this example, the parametric audio coding of the 5.1 signals is based on two three-dimensional PCAs of the signals separated along the mid-plane.

Figure 12:
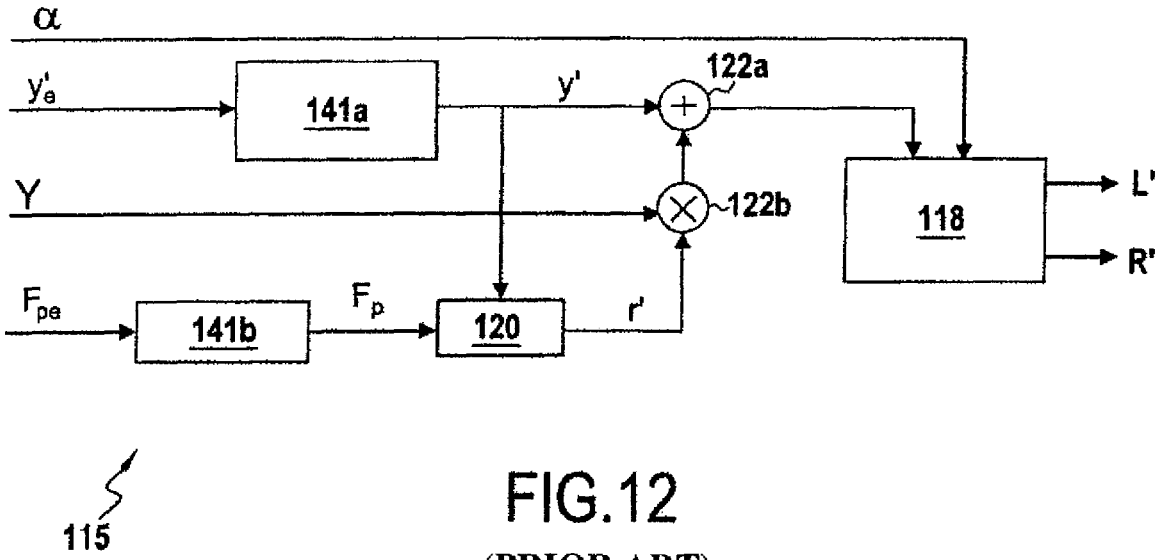
FIG.12 (PRIOR ART)

Thus, this encoder 209 makes it possible to carry out a first $PCA_1$ of the triple 80$a$ of signals $(L, C, L_s)$ according to the encoder 109 of FIG. 12 and likewise, a second $PCA_2$ of the triple 80$b$ of signals $(R, C, R_s)$ according to the encoder 109.

Thus, the pair of principal components $(CP_1, CP_2)$ can be considered to be a stereophonic signal (L, R) spatially coherent with the original multi-channel signal.

It is appropriate to specify that the LFE signal can be coded independently of the other signals since the discrete-nature low-frequency content of this channel is almost insensitive to the reduction in the inter-channel redundancies.

The encoding adapts to the bit rate constraints of the transmission network by transmitting a stereophonic signal coded by a stereophonic audio coder 81$a$ accompanied by parameters quantized by quantizing means 81$a$ to 81$d$, as well as quantizing means 91$a$ to 91$d$ defined for each frame n and each frequency subband $b_i$.

Thus, the stereophonic audio coder 81$a$ makes it possible to code the pair of principal components $(CP_1, CP_2)$. The quantizing means 81$b$ make it possible to quantize the Euler angles $(\alpha,\beta,\gamma)$ that are useful for the PCAs of each triple of signals.

The quantizing means 81$d$ make it possible to quantize the values $c_1(n)$ and $c_2(n)$ determining the choice of the filter to be used for each triple of signals.

Furthermore, frequency synthesis means 45 comprising filtering and frequency analysis means 83$a$ and 83$b$ make it possible to determine frequency subband-based parameters or energy differences $E_{ij}(n,b)$ $(1\leqq i,j\leqq 2)$ between the signals $CP_1$ and $A_{11}$, $A_{12}$ as well as the signals $CP_2$ and $A_{21}$, $A_{22}$ respectively.

As a variant, the energy parameters can correspond to the subband-based energies of the signals $A_{11}$, $A_{12}$ and $A_{21}$, $A_{22}$.

The energy parameters $E_{ij}(n,b)$ can then be quantized by the quantizing means 81$c$.

Furthermore, the fine residual structures $Sf_{Aij}(n,b)$ with $1 \leqq i,j \leqq 2$ of the four residual or ambiance signals $A_{11}, A_{12}$ and $A_{21}, A_{22}$ arising from the 3D PCAs can be quantized by the quantizing means 91*a* to 91*d*.

Just as for the coding of the stereophonic signals, at least one part of the fine structures $Sf_{Aij}(n,b)$ of the residual signals $A_{11}, A_{12}$ and $A_{21}, A_{22}$ can be transmitted as additional information using a higher bit rate and consequently a superior audio reconstruction quality.

Figure 10:
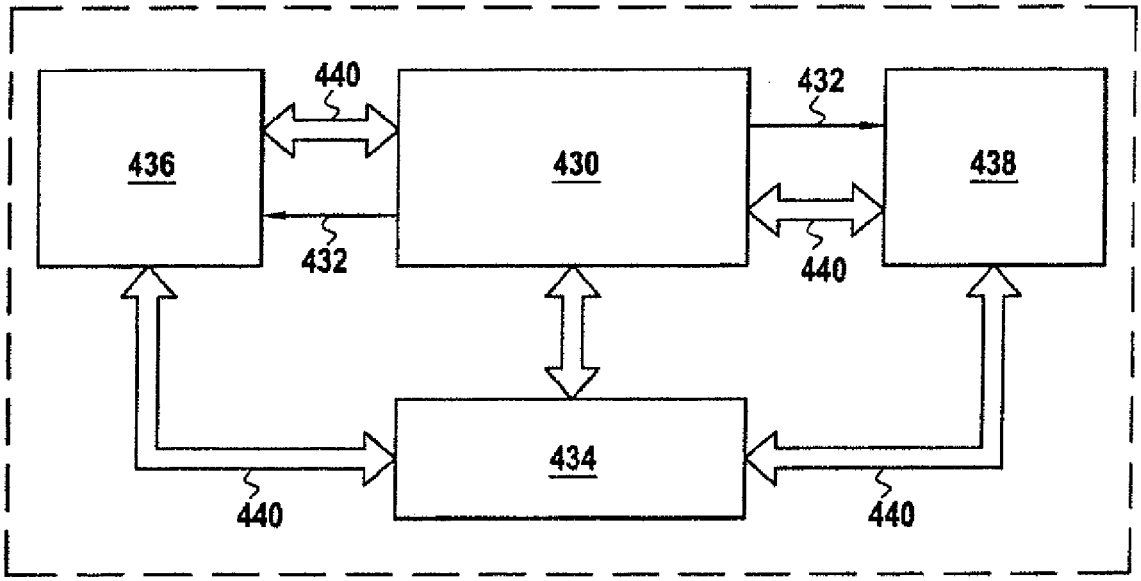
FIG. 10 is a schematic view of a computerized system implementing the encoder and the decoder according to FIGS. 1 to 9, and FIGS. 11 and 12 are schematic views of the encoders and decoders according to the prior art.
Figure 11:
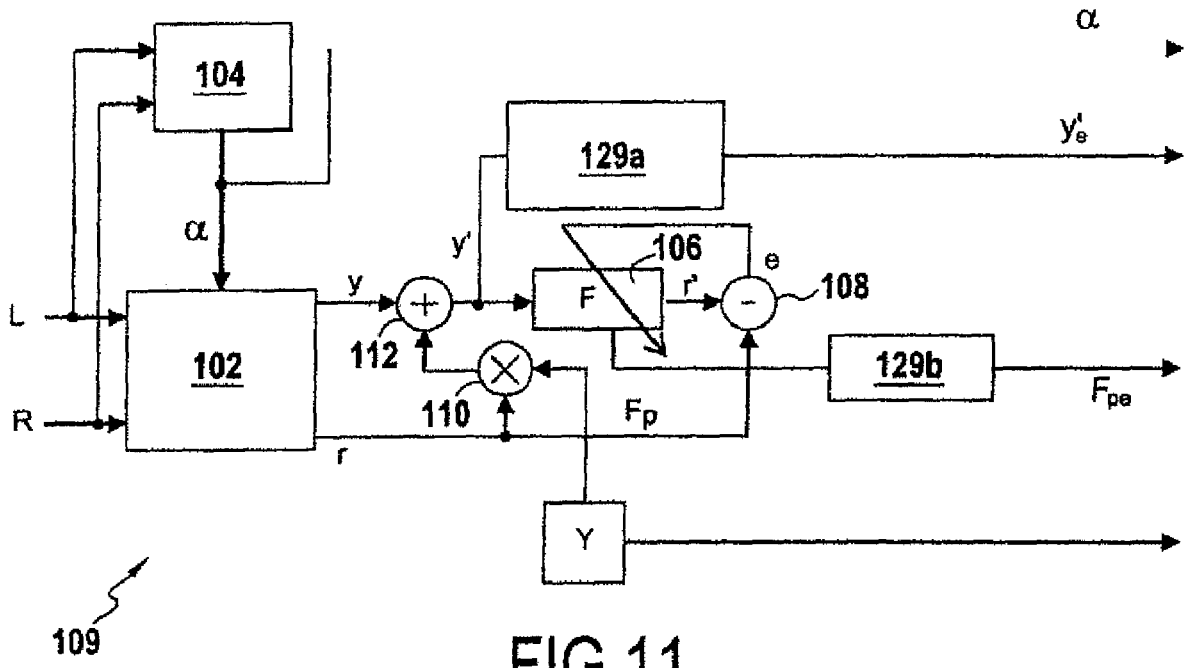
FIG.11 (PRIOR ART)

FIG. 10 very schematically illustrates a computerized system implementing the encoder or the decoder according to FIGS. 1 to 19. This computerized system comprises in a conventional manner a central processing unit 430 controlling by signals 432 a memory 434, an input unit 436 and an output unit 438. All the elements are linked together by data buses 440.

Moreover, this computerized system can be used to execute a computer program comprising program code instructions for implementing the coding or decoding method according to the invention.

Specifically, the invention is also aimed at a computer program product downloadable from a communication network comprising program code instructions for executing the steps of the coding or decoding method according to the invention when it is executed on a computer. This computer program can be stored on a medium readable by computer and can be executable by a microprocessor.

This program can use any programming language, and be in the form of source code, object code, or code intermediate between source code and object code, such as in a partially compiled form, or in any other desirable form.

The invention is also aimed at an information medium readable by a computer, and comprising instructions of a computer program such as mentioned above.

The information medium can be any entity or device capable of storing the program. For example, the medium can comprise a storage means, such as a ROM, for example a CD ROM or a microelectronic circuit ROM, or else a magnetic recording means, for example a diskette (floppy disc) or a hard disc.

Moreover, the information medium can be a transmissible medium such as an electrical or optical signal, which can be trunked via an electrical or optical cable, by radio or by other means. The program according to the invention can be in particular downloaded from a network of Internet type.

Alternatively, the information medium can be an integrated circuit into which the program is incorporated, the circuit being adapted to execute or to be used in the execution of the method in question.

Thus, the invention allows a bit rate-scalable audio coding. This offers the capability of approaching an asymptotically perfect reconstruction of the original signals. Specifically, using a higher bit rate, the reconstructed signal will be perceptually closer to the original signal.

Furthermore the method according to the invention is graduated in terms of number of decoded channels. For example, the coding of a signal in the 5.1 format also allows decoding as a stereophonic signal so as to ensure compatibility with various playback systems.

The fields of application of the present invention are digital-audio transmissions on diverse transmission networks at various bit rates since the proposed procedure makes it possible to adapt the coding bit rate as a function of the network or of the quality desired.

Moreover, this method is generalizable to multi-channel audio coding with a larger number of signals. Specifically, the proposed procedure is by nature generalizable and applicable to numerous 2D and 3D audio formats (6.1, 7.1 formats, ambisonic, wave field synthesis, etc.).

A particular exemplary application is the compression, transmission and then playback of a multi-channel audio signal on the Internet following an order/purchase by a cybernaut (listener). This service is moreover commonly called "audio on demand". The proposed procedure then makes it possible to encode a multi-channel signal (stereophonic or of 5.1 type) at a bit rate supported by the Internet network linking the listener to the server. Thus, the listener can listen to the sound scene decoded in the format desired on his multi-channel broadcasting system. In the case where the signal to be transmitted is of 5.1 type but the user does not possess a multi-channel playback system, the transmission can then be limited to the principal components of the starting multi-channel signal; and subsequently, the decoder delivers a signal with fewer channels such as a stereophonic signal for example.

The invention claimed is:

1. A scalable coding method of a multi-channel audio signal $(C_1, \ldots, C_M)$, wherein the method comprises the steps of:

transforming, using a principal component analysis (PCA), at least two channels (L,R) of the audio signal into a principal component (CP) and at least one residual sub-component (r) by rotation defined by a transformation parameter (θ);

forming a residual structure $(Sf_r)$ per frequency subband on the basis of the at least one residual sub-component (r); and forming a coded audio signal (SC) comprising the principal component (CP), the residual structure $(Sf_r)$ of at least one frequency subband, according to a determined order of transmission of the residual structures of the frequency subbands and the transformation parameter (θ).

2. The method according to claim 1, comprising a formation of at least one energy parameter (E) as a function of the at least one residual sub-component (r).

3. The method according to claim 2, wherein said at least one energy parameter (E) is formed by a frequency subband-based extraction of energy difference between a decomposition of the principal component (CP) and the at least one residual sub-component (r).

4. The method according to claim 2, wherein said at least one energy parameter (E) corresponds to a subband-based energy of the at least one residual sub-component (r).

5. The method according to claim 2, comprising a frequency analysis applied to the at least one residual sub-component (r) as a function of the at least one energy parameter (E) so as to form the residual structures $(Sf_r)$ of the frequency subbands.

6. The method according to claim 1,wherein said determined order of transmission is carried out according to a perceptual order of the subbands or an energy criterion.

7. The method according to claim 1, wherein said at least one residual sub-component is a frequency residual sub-component (A(n,b)) carried out according to a principal component analysis in the frequency domain.

8. The method according to claim 7, wherein the principal component analysis (PCA) transformation in the frequency domain comprises the steps of:

decomposing the at least two channels (L, R) of the said audio signal into a plurality of frequency subbands $(l(n, b_1), \ldots, l(n,b_N), r(n,b_1), \ldots, r(n,b_N))$;

calculating the at least one transformation parameter ($\theta(n, b_i)$) as a function of at least a part of the said plurality of frequency subbands;

transforming at least a part of the plurality of frequency subbands into the said at least one frequency residual sub-component ($A(n,b_1), \ldots, A(n,b_N)$) and at least one frequency principal sub-component ($CP(n,b_1), \ldots, CP(n,b_N)$) as a function of the at least one transformation parameter ($\theta(n,b_1), \ldots, \theta(n,b_N)$); and forming the principal component (CP(n)) on the basis of the at least one frequency principal sub-component ($CP(n,b_1), \ldots, CP(n,b_N)$).

9. The method according to claim 8, wherein said plurality of frequency subbands ($l(n,b_1), \ldots, l(n,b_N), r(n,b_1), \ldots, r(n,b_N)$) is defined in accordance with a perceptual scale.

10. The method according to claim 1, comprising a frequency subband-based analysis of the at least one residual sub-component (r).

11. The method according to claim 10, wherein said frequency subband-based analysis comprises the steps of:

applying a short-term Fourier transform (STFT) to the at least one residual sub-component (r) to form at least one frequency residual sub-component (r(b)); and filtering of the at least one frequency residual sub-component by a frequency filter bank to obtain the residual structures $Sf_r(b)$ of the frequency subbands.

12. The method according to claim 1, comprising an analysis of correlation between the at least two channels (L, R) to determine a corresponding correlation value (c), and in that the coded audio signal furthermore comprises the correlation value (c).

13. The method of decoding a reception signal comprising a coded audio signal constructed according to claim 1, the decoding method comprising a transformation by inverse principal component analysis ($PCA^{-1}$) to form at least two decoded channels (L', R') corresponding to the at least two channels (L, R) arising from the original multi-channel audio signal, wherein the method comprises the decoding of at least one residual structure ($Sf_r$) of a frequency subband so as to synthesize at least one decoded residual sub-component (r'; A'(n,b)).

14. The decoding method according to claim 13, comprising the steps of:

receiving the coded audio signal (SC);

extracting a decoded principal component (CP') and at least one decoded transformation parameter;

decomposing the decoded principal component (CP') into at least one decoded frequency principal sub-component;

transforming the at least one decoded principal sub-component and the at least one decoded residual sub-component (A'(n,b)) into decoded frequency subbands; and combining the decoded frequency subbands to form the at least two decoded channels (L', R').

15. The decoding method according to claim 13, comprising the steps of:

receiving the coded audio signal (SC);

extracting a decoded principal component (y') and at least one decoded transformation parameter; and forming the at least two channels (L', R') decoded by the inverse principal component analysis as a function of the at least one decoded transformation parameter, of the decoded principal component (y') and of the at least one decoded residual sub-component (r').

16. A scalable decoder of a reception signal comprising a coded audio signal constructed according to claim 1, the decoder comprising transformation means based on inverse principal component analysis ($PCA^{-1}$) for forming at least two decoded channels (L', R') corresponding to the at least two channels (L, R) arising from the original multi-channel audio signal, wherein the decoder comprises frequency synthesis means for decoding at least one residual structure ($Sf_r$) of a frequency subband so as to synthesize at least one decoded residual sub-component (r'; A'(n,b)).

17. System comprising:

a scalable encoder of a multi-channel audio signal ($C_1, \ldots, C_M$), comprising transformation means based on principal component analysis (PCA) transforming at least two channels (L, R) of the audio signal into a principal component (CP) and at least one residual sub-component (r) by rotation defined by a transformation parameter ($\theta, \theta(b_i)$), wherein the encoder comprises:

(i) structure formation means for forming a frequency subband-based residual structure ($Sf_r$) on the basis of the at least one residual sub-component (r), and (ii) defining means for defining a coded audio signal (SC) comprising the principal component (CP), at least one residual structure ($Sf_r$) of a frequency subband and the transformation parameter ($\theta$); and a scalable decoder of a reception signal comprising a coded audio signal constructed according to claim 1, the decoder comprising transformation means based on inverse principal component analysis ($PCA^{-1}$) for forming at least two decoded channels (L', R') corresponding to the at least two channels (L, R) arising from the original multi-channel audio signal, wherein the decoder comprises frequency synthesis means for decoding at least one residual structure ($Sf_r$) of a frequency subband so as to synthesize at least one decoded residual sub-component (r'; A'(n,b)).

18. A computer program downloadable from a communication network and/or stored on a non-transitory medium readable by computer and/or executable by a microprocessor, wherein the computer program comprises program code instructions for executing the steps of the coding method according to claim 1, when it is executed on a computer or a microprocessor.

19. A computer program downloadable from a communication network and/or stored on a non-transitory medium readable by computer and/or executable by a microprocessor, wherein the computer program comprises program code instructions for executing the steps of the decoding method according to claim 13, when it is executed on a computer or a microprocessor.

20. The method according to claim 1, wherein said determined order of transmission is carried out according to a correlation of the components arising from the principal component analysis in subbands.

21. A scalable encoder of a multi-channel audio signal ($C_1, \ldots, C_M$), comprising transformation means based on principal component analysis (PCA) transforming at least two channels (L, R) of the audio signal into a principal component (CP) and at least one residual sub-component (r) by rotation defined by a transformation parameter ($\theta, \theta(b_i)$), wherein the encoder comprises:

structure formation means for forming a residual structure ($Sf_r$) per frequency subband on the basis of the at least one residual sub-component (r); and defining means for defining a coded audio signal (SC) comprising the principal component (CP), the residual structure ($Sf_r$) of at least one frequency subband, according to a determined order of transmission of the residual structures of the frequency subbands, and the transformation parameter ($\theta$).

* * * * *